US005956073A

United States Patent [19]

Jin et al.

[11] Patent Number: 5,956,073

[45] Date of Patent: Sep. 21, 1999

[54] NOISE-LIMITING TRANSFORMER APPARATUS AND METHOD FOR MAKING

[75] Inventors: Sungho Jin, Millington; Joseph Michael Nemchik, Florham Park; Robert Bruce Van Dover, Maplewood; Wei Zhu, Warren, all of N.J.

[73] Assignee: Lucent Technologies Inc., Murray Hill, N.J.

[21] Appl. No.: 08/770,613

[22] Filed: Dec. 19, 1996

[51] Int. Cl.[6] ..... H01F 27/28

[52] U.S. Cl. ..... 348/6; 336/182; 336/220; 336/30; 336/160; 336/165; 336/221; 336/223; 336/178

[58] Field of Search ..... 336/182, 220, 336/30, 160, 165, 221, 233, 178; 348/6, 7, 12; H01F 27/28

[56] References Cited

U.S. PATENT DOCUMENTS 5,426,409 6/1995 Johnson ..... 336/178

FOREIGN PATENT DOCUMENTS 24 53 988 5/1976 Germany .

OTHER PUBLICATIONS

"Microfabrication of Transformers and Inductors for High Frequency Power Conversion" by Charles R. Sullivan and Seth R. Sanders, *Proceedings 24th Annual Power Electronics Specialists Conference*, Jun. 1994, pp. 33–40.

"CATV Return Path Characterization for Reliable Communications", by Charles A. Eldering, Nageen Himayat, and Floyd M. Gardner, *IEEE Communications Magazine*, Aug. 1995, pp. 62–69.

*Primary Examiner*—Nathan Flynn

*Attorney, Agent, or Firm*—John M. Harman

[57] ABSTRACT

Embodiments of the invention include a transformer device having a saturation region for limiting ingress noise and other noise. The transformer comprises a magnetic core, an input coil and an output coil arranged so that the output signal caused by the magnetic linkage between the input and output coils through the magnetic core is based on the magnitude of the input signal. According to an embodiment of the invention, the magnetic core includes a saturation region that limits the output signal regardless of the magnitude of the input signal once the saturation region reaches its saturation magnetization state. The saturation region comprises a reduced saturation magnetization level caused by a geometrically constricted region of the magnetic core or, alternatively, by a modified, magnetic-equivalent region having properties similar to a geometrically constricted region.

17 Claims, 5 Drawing Sheets

NOISE-LIMITING TRANSFORMER APPARATUS AND METHOD FOR MAKING

BACKGROUND OF THE INVENTION

1. Field of the Invention

The invention relates to transformers. More particularly, the invention relates to noise-limiting transformers suitable for use in, e.g., bidirectional communications schemes using local access coaxial cables.

2. Description of the Related Art

Most homes in the United States have coaxial cable lines installed to their homes, primarily for entertainment purpose. The use of the coaxial cable lines for two-way communications, either entirely or locally as a part of a Hybrid-Fiber-Coax (HFC) communications system arrangement with the coaxial cable portion connecting the distribution fiber node to each home, is an economically viable alternative to the use of existing telephone lines (i.e., conventional twisted pair copper wires), or yet-to-be realized fiber-to-home or wireless local access configurations.

Currently, the HFC architecture is used mostly for one-way (downstream) transport of multiplexed signals to subscribers, e.g., with a downstream bandwidth of about 50–750 Megahertz (MHz). However, the HFC architecture is being considered as a promising, bidirectional, broadband communications infrastructure for the multibillion dollar communications market in part because of the low deployment cost expected. Conventional system architecture uses an upstream bandwidth of about 5–40 MHz, but the possibility of higher frequency (e.g., 750–1000 MHz) regimes also exist as information transmission increases in the future with the addition of more video, Internet and other applications. Accordingly, there exists a need for improved devices and equipment to support and maintain reliable, bidirectional HFC communications systems using this high rate of information transmission.

However, one of the main barriers to the reliable operation of bidirectional HFC communications systems is the noise problem, commonly know as the "ingress". Because the HFC architecture typically consists of conventional tree-and-branch arrangements, the upstream transmission from various subscribers to the headend (central) office is shared. Thus, ingress noise, e.g., from individual subscriber homes and the overall cable structure, are added onto the main upstream transmission signals, inadvertently affecting the transmission of other subscribers. Such behavior typically is referred to as noise funneling. See, e.g., C. A. Eldering, e.g., "CATV Return Path Characterization for Reliable Communications", IEEE Communications Magazine, August 1995, p. 62.

Accordingly, a need exists for noise-limiting devices to reduce the problem of ingress noise and thereby improve efficiency among two-way communications using, e.g., HFC architecture.

SUMMARY OF THE INVENTION

The invention is embodied in a transformer device having a saturation region for limiting ingress noise and other noise within communications and other systems. The transformer comprises a magnetic core, an input coil and an output coil arranged so that the output signal caused by the magnetic linkage between the input and output coils through the magnetic core is responsive to the magnitude of the input signal. According to an embodiment of the invention, the magnetic core includes a saturation region having a reduced saturation magnetization level that limits the output signal to be regardless of the magnitude of the input signal once the saturation region reaches its saturation magnetization level. The reduced saturation magnetization level of the saturation region is caused by geometric constriction of a portion of the magnetic core, which reduces the potential maximum magnetic flux flow through the region. Alternatively, the saturation region is a geometric constriction-equivalent region with a "magnetic-equivalent" region modified to exhibit material properties similar to a geometrically constricted region. The, transformer is suitable for high frequency (e.g., $\geqq$0.1 MHz) use in communications and other systems for limiting noise such as ingress noise often inherent in such systems.

BRIEF DESCRIPTION OF THE DRAWINGS

In the drawings:

FIG. 9(*b*) is a perspective view of a transformer according to an embodiment of the invention shown using surface exchange coupling with an additional magnetic layer for magnetic saturation in the easy direction to avoid magnetic domains and associated domain wall motion;

FIG. 9(*c*) is a perspective view of a transformer according to an embodiment of the invention shown inducing high coercivity in the easy axis of the magnetic core film for magnetic saturation in the easy direction to avoid magnetic domains and associated domain wall motion.

Figure 1:
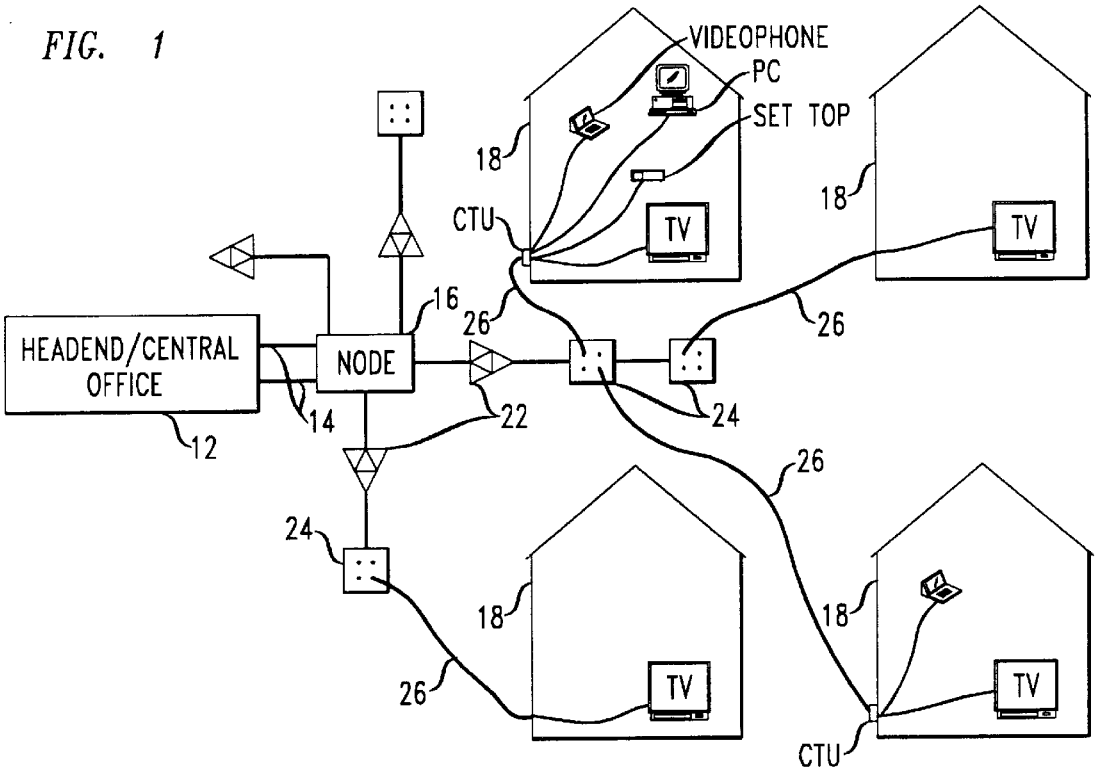
FIG. 1 is a schematic diagram illustrating a conventional HFC communications system arrangement.

It is to be understood that the drawings are to illustrate the concepts of the invention and are not to scale.

DETAILED DESCRIPTION

In the following description, similar components are referred to by the same reference numeral in order to simplify the sequential aspect of the drawings.

Referring to FIG. 1, a conventional Hybrid Fiber-Coax (HFC) architecture is shown. The conventional architecture includes at least one headend or central office 12 operably connected, e.g., via one or more single mode fibers 14, to at least one node 16 for downstream transmission of signals thereto. Typically, each node 16 serves approximately 500 to 2000 homes or other subscriber or customer premises (shown generally as 18) through a plurality of actives 22, taps 24 and coaxial fiber lines 26, as shown generally. Node 16 converts optical signals received from central office 12 to corresponding electrical signals as well as provides amplification for transmission of these signals to the coaxial cable portion 26 of the network that connects to homes 18.

As previously discussed, upstream transmission (i.e., transmission from communications peripherals in homes 18 to headend office 12) suffers from ingress noise appearing on the cable return path. Such peripherals include, e.g., computers, telephones and televisions. Ingress noise includes, e.g., narrowband short-wave signals, impulse noise (e.g., noise generated by electrical motors, engine ignitions, power switching, computers, digital equipment, lightning, electrostatic discharge), common mode distortion (e.g., distortion caused by nonlinearities in the cable equipment such as oxidized connectors and fittings), and location-specific, subscriber-induced interference (e.g., interference caused by the operation of amateur radios or other high-power, high-frequency devices).

Figure 2A:
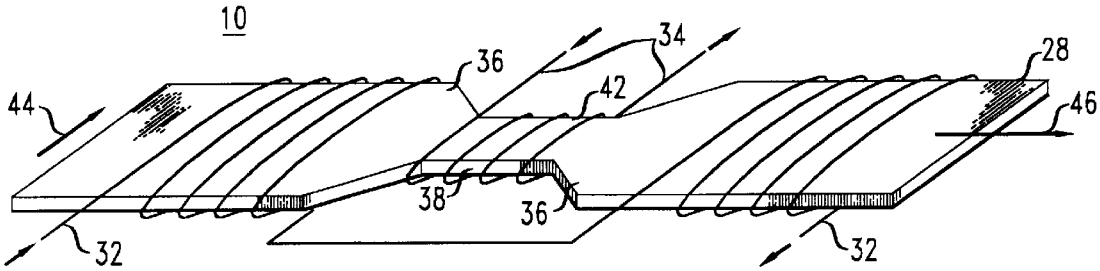
FIGS. 2A–2B are perspective views of a transformer according to an embodiment of the invention.

A noise-limiting transformer 10 according to an embodiment of the invention is shown in FIG. 2*a*. Transformer 10 comprises a magnetic core material 28, an input coil 32 and an output coil 34. Magnetic core 28 is made of one or more thin or thick film soft magnetic materials such as iron-based nanocrystalline amorphous materials, permalloys and ferrites. As shown, magnetic core 28 has one or more input core regions 36 for the input signal and at least one output region 38 for the output signal.

Input coil 32, which typically carries the upstream signal (i.e., the signal from homes 18 to headend office 12), is wound around input core region 36 of magnetic core 28 and magnetizes the core material in proportion to the magnitude of the input signal current. As shown, output coil 34 is wound around output core region 38 of magnetic core 28, whose output region generates a current within output coil 34 whose magnitude typically is based on the magnitude of the input current. Alternatively, as shown in FIG. 2*b*, input coil 32 is wound on only one side of output coil 34 if satisfactory output signal intensity and quality are obtainable.

Figure 2B:
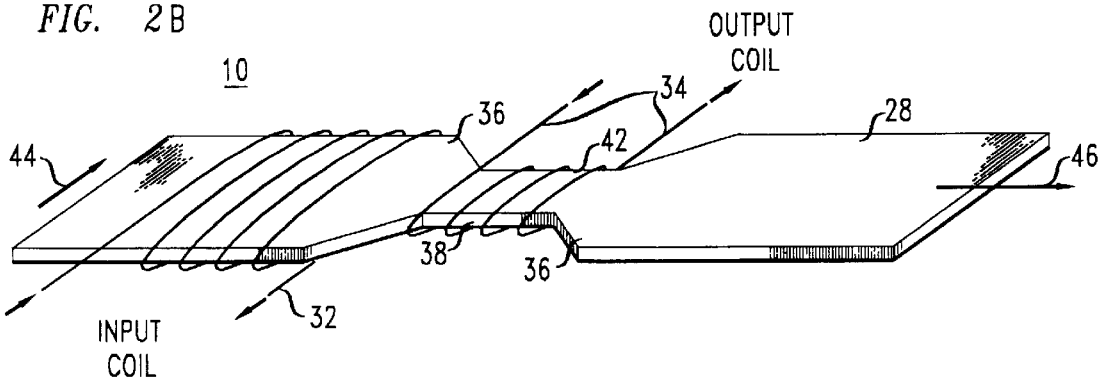

According to embodiments of the invention, as shown in FIGS. 2*a–b*, output region 38 of magnetic core 28 includes at least one saturation region 42. As will be discussed in greater detail below, for purposes of discussion in this description, the term "saturation region" is understood to be any region that alters the conventional input/output relationship of an electromagnetic device such as a transformer. Furthermore, it is understood that the term "saturation region" includes any region within an electromagnetic device that reaches a characteristic saturation magnetization in such a way as to effectively limit the maximum magnetic flux density therein.

For example, in FIGS. 2*a–b*, saturation region 42 is a geometrically constricted region around which output coil 34 is wound. An output region 38 having a geometrically constricted saturation region 42 typically is characterized by a smaller cross-sectional area and/or volume than the corresponding input region(s) 36 around which input coil 32 is wound. Such geometrically constricted regions are prepared, e.g., by patterned deposition or patterned removal of selected portions of magnetic core 28.

In typical operation, the larger volume (and hence the larger magnetic flux) of input core region 36 serves to amplify the output signal by magnetizing the smaller volume of output core region 38 to a state of higher magnetic flux density approaching its saturation value. When the input signal reaches a certain level (e.g., by ingress noise), the saturation region portion of output region 38 reaches its saturation magnetization, at which point the output signal is limited by the saturation value, even if the level of the input signal (noise) keeps increasing.

In this manner, the presence of geometrically constricted saturation region 42 places an upper limit on the maximum magnetic flux density in the portion of magnetic core 28 around which output coil 34 is wound, and hence limits the magnitude of the output signal generated within output coil 34, regardless of, e.g., an excessive input signal at input coil 32.

Desirably, magnetic core 28 is made of a material that exhibits some combination of a strong anisotropy and a square magnetic hysteresis (M-H) loop along the easy axis of magnetization. For example, in FIG. 3, a representative loop is shown for a core material having a thickness of approximately 1000 Å and made of, e.g., Fe-4.6% Cr-0.2% Ta-7.4% N atomic % alloy, that was triode sputter deposited near room temperature on a quartz substrate containing an approximately 100 Å thick chromium (Cr) top layer. Advantageously, the addition of the Cr top layer improves the squareness of the M-H loop.

For the device of FIGS. 2*a–b*, the material of magnetic core 28 is magnetically biased so that the easy axis of magnetic core 28 is in the direction indicated by arrow 44. Easy axis biasing is achieved, e.g., by applying an external field (such as by placing a permanent magnet nearby) or by adding an exchange interaction bias layer (such as by depositing a thin NiO or Fe—Mn film above or below a soft magnetic permalloy [80%Ni—20%Fe] film).

The easy axis is approximately orthogonal to the direction of the magnetic field (indicated by arrow 46) applied by input coil 32 and sensed by output coil 34. The plot of the M-H loop for the hard and easy axes is shown in FIG. 3.

In typical operation of transformer 10, alternating current (AC) signals are applied in the direction of the hard axis loop, i.e., in the direction indicated by arrow 46. The material of magnetic core 28 is pre-saturated by a direct current (DC) field along the easy axis (arrow 44) so that the magnetic domain walls are essentially removed. The easy axis saturation is maintained by either bias field, exchange coupling, or high coercivity of the material itself in magnetic core 28. With high-frequency alternating current (AC) field operation along the hard axis loop, the pre-saturation along the easy axis allows magnetization change to occur predominantly by spin rotation without domain wall motion. The elimination of domain wall motion during the hard axis operation of transformer 10 helps the M-H loop to be tightly closed, e.g., as shown in FIG. 3, and reduces energy loss such as hysteresis loss.

The desired magnetic properties of the material of magnetic core 28 for embodiments of the invention are as follows. The easy axis loop should be square, with a squareness ratio (i.e., remanence to saturation ratio, $M_r/M_s$) greater than approximately 0.85 or even greater than approximately 0.95. The easy axis coercivity, $H_c$, should be high enough for the sake of stability but should still be low enough to maintain soft magnetic properties. For example, it is desirable to have $H_c$ in the range of approximately 1–1000 oersted (Oe), or even within the range from approximately 5 or 20 Oe to approximately 100 Oe. Also, it is desirable to have a saturation magnetization ($4\pi M_s$) greater than approximately 3 kilogauss (kG), or even a saturation magnetization of greater than approximately 8 kG or approximately 16 kG.

Figure 3:
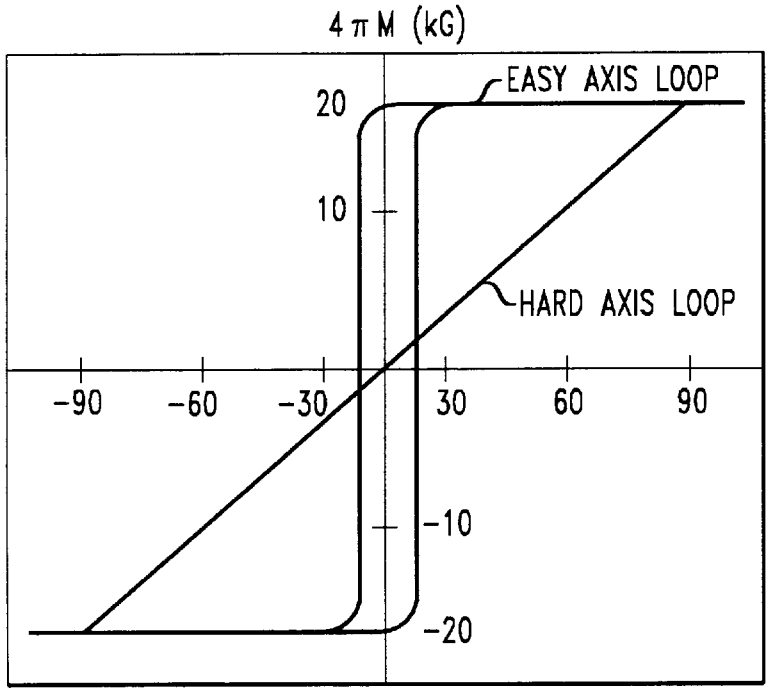
FIG. 3 depicts magnetic hysteresis (M-H) loops for thin film core materials of a Fe—Cr—Ta—N alloy along the easy axis of magnetization and along the hard axis of magnetization.

In terms of hard axis loop characteristics, a closed and linear loop such as shown in FIG. 3 is desirable. The anisotropy field, $H_a$, defined as the field strength required to overcome the anisotropy and achieve saturation in the hard axis direction, should be at least approximately 2 Oe. However, having $H_a$ greater than approximately 10 Oe or even 30 Oe also is desirable.

Having the magnetic properties of the material of magnetic core 28 characterized by such a value of $H_a$ along with such a saturation magnetization value is desirable because it is possible for magnetic fields associated therewith to push the onset of undesirable ferromagnetic resonance and accompanying energy absorption and deterioration of magnetic permeability to higher frequencies well beyond the operating frequency range of the transformer, e.g., operating frequencies greater than approximately 1 MHz, 10 MHz or even 100 MHz.

Figure 4:
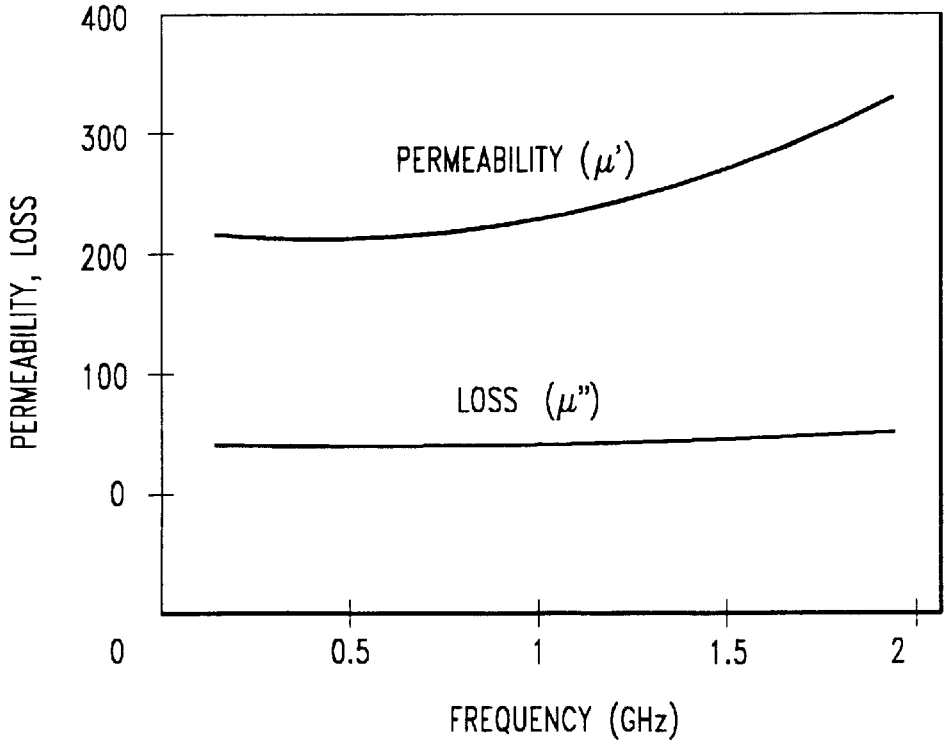
FIG. 4 is a plot of a hard axis magnetic permeability spectrum up to a frequency of approximately 2 Gigahertz (GHz) for a Fe—Cr—Ta—N alloy film bias saturated along the easy axis of magnetization.

FIG. 4 shows the permeability spectrum as a function of frequency for a magnetic film having the characteristics shown in FIG. 3. The AC permeability is measured along the hard axis using a magnetic field of approximately 10 mOe) after saturation along the easy axis. The AC permeability is maintained and the onset of substantial loss does not occur within an operating frequency of up to at least 2 GHz, as the ferromagnetic resonance (FMR) frequency is pushed beyond the 2 GHz level in the film characterized by FIG. 3. As is known to those skilled in the art, ferromagnetic resonance is a resonating phenomenon occurring between the applied AC field and the resonating frequency of the magnetic core.

Suitable magnetic materials processed to exhibit the above mentioned properties include thin or thick films and ribbons of soft magnetic materials such as Fe-based, Co-based or Ni-based alloys, ferrites, amorphous materials. Furthermore, suitable materials include permalloy (80%Ni-20%Fe), Fe-refractory metal films such as Fe—Ta, Fe—Zr, Fe—Hf, Fe—Nb, Fe—Ti with the refractory metal content typically in the range of approximately 0.5–10 wt %, Co—Fe based soft magnetic films with the Fe content typically in the range of approximately 10–80 wt %, and soft ferrites such as Ni—Zn ferrite or Mn—Zn ferrite.

In general, thin film magnetic materials are more desirable than thick film or ribbon materials for minimizing eddy current loss in high frequency operations, e.g., frequencies above approximately 10 Mhz. For example, the overall thickness of magnetic films according to embodiments of the invention often are within the range from approximately 0.01 to 100 $\mu$m, with the thickness of individual layers often within the range from approximately 0.05 to 5 $\mu$m. Also, according to embodiments of the invention, it is possible to use a multilayer configuration with insulating intermediate layers to further reduce the eddy current effect in a larger volume core materials.

The thin films are deposited by any one of a number of known processing methods, such as physical vapor deposition (using sputtering), evaporation, ion beam deposition, laser ablation, electrochemical means (using electroplating or electroless deposition) and chemical vapor deposition. Often, as-deposited films are used without post heat treatment at high temperatures to minimize the danger of degrading other components or materials in the inventive devices. Characteristics of the magnetic properties of such as-deposited films are shown, e.g., in FIG. 3 and 4, discussed previously. Also, such thin-film deposition methods are disclosed in detail, e.g., in co-pending application Ser. No. 08/595,543, filed Feb. 02, 1996 and assigned to the assignee of this application.

It is possible to use films having a thickness greater than approximately 20 $\mu$m) if the material of the magnetic core has relatively high electrical resistivity (e.g., greater than approximately 500 $\mu\Omega$/cm) and the operating frequency is relatively low (e.g., less than approximately 100 MHz). Such films are deposited and patterned using known techniques such as spray coating, screen printing, ink jet printing, doctor-blade coating using a powder-slurry approach, or plasma spray, electroplating, and sol-gel coating. Films processed by using a powder-containing precursor generally require post heat treatment for the purpose of sintering or stress relief annealing.

Substrates for deposition of films according to embodiments of the invention include insulators such as glass, quartz, $Al_2O_3$, $Y_2O_3$, Y-stabilized zirconia, $LaAlO_3$, $LaGaO_3$, $SrTiO_3$, polyimide, or semiconductors such as Si or GaAs. Alternatively, a combination substrate having a thin interlayer coating of an insulator, semiconductor or metal formed on the surface of the base substrate is used for the purpose of enhancing texture formation, crystallization or adhesion. For example, such combination substrate includes a thin Cr coating (20–500 Å thick) formed on Si, glass or quartz.

Figure 5:
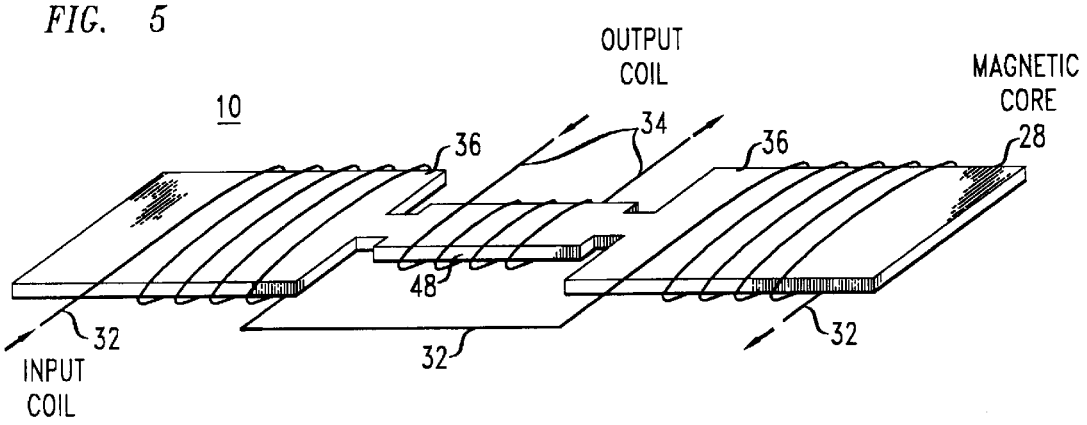
FIG. 5 is a perspective view of a noise-limiting transformer according to an alternative embodiment of the invention.

Referring to FIG. 5, an alternative embodiment of the invention is shown. Instead of having a geometrically constricted region as described above, the noise-limiting transformer has a "magnetic-equivalent" constriction region 48. For purposes of discussion in this description, a "magnetic-equivalent" constriction region is a region whose material properties have been modified in such a way that the region demonstrates the saturation magnetic induction characteristics of a geometrically constricted region as described herein. Typically, the region is modified to intentionally deteriorate the local magnetic properties of the region to cause a lower saturation moment. Specifically, a "magnetic-equivalent" constriction region is created, e.g., by locally modifying the chemical composition, crystal structure or internal stress state of the material of magnetic core 28.

Methods used to alter the chemical composition and hence reduce the saturation magnetization of the region of interest include, e.g., local ion implantation of alloying elements (e.g., C, N, O, B, C), local carburizing, nitriding, and oxidizing heat treatment. Methods such as local laser beam heating are used for the carburizing, nitriding or oxidizing heat treatment. Also, local laser beam heating is used to modify the crystal structure by inducing phase transformation through rapid cooling to a metastable, lower saturation or non-magnetic phase, e.g., body-centered cubing (bcc) martensite to face-centered cubing (fcc) austenite phase in iron-rich alloys or from a crystalline to an amorphous structure.

Alternatively, internal stress is created in the local region of interest by rapid heating and cooling thereof (e.g., by laser) to bring about intentional, magnetostriction-induced deterioration therein. Also, internal stress is created by depositing a foreign material (e.g., a narrow strip of thin films with a different volume expansion coefficient) locally over the soft magnetic film so as to cause deposition-induced or transformation-induced stress.

Figure 6:
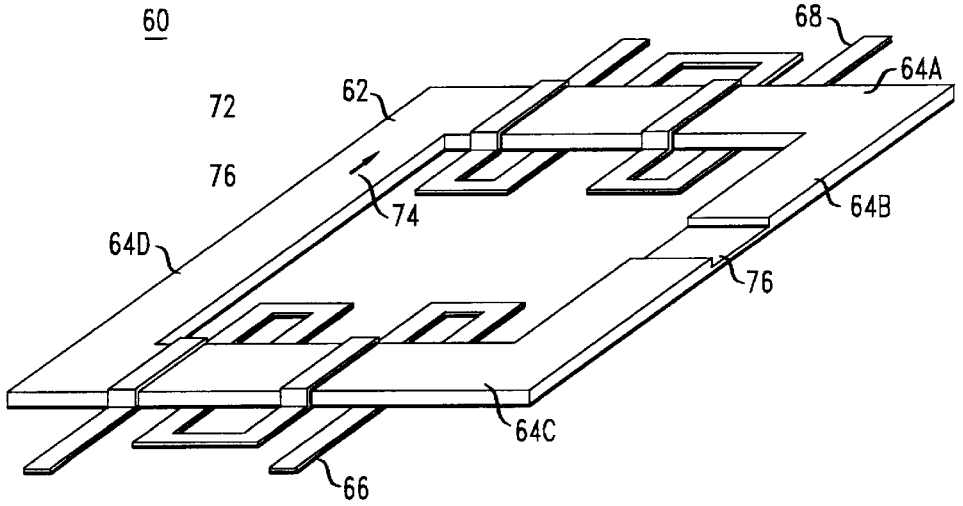
FIG. 6 is a perspective view of a transformer according to yet another embodiment of the invention showing the transformer having thin film magnetic layers and conductors.
Figure 7:
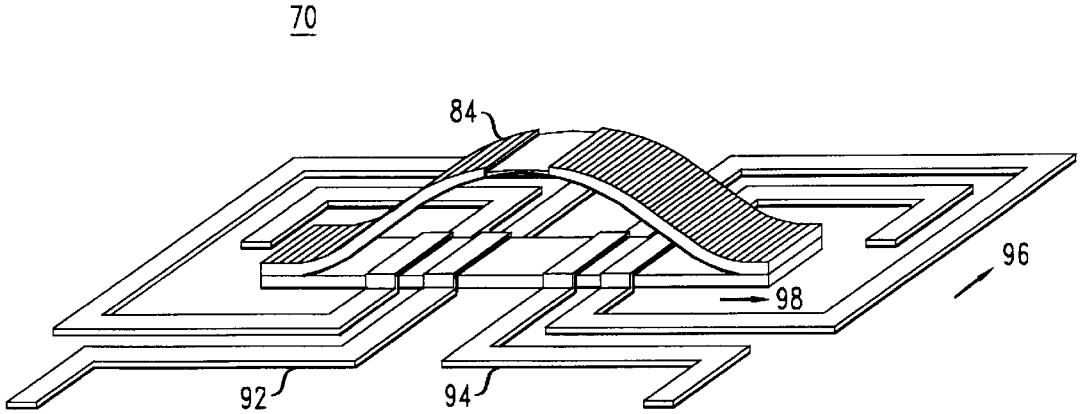
FIG. 7 is a perspective view of a transformer according to still another embodiment of the invention showing the transformer having an E-core configuration.
Figure 8:
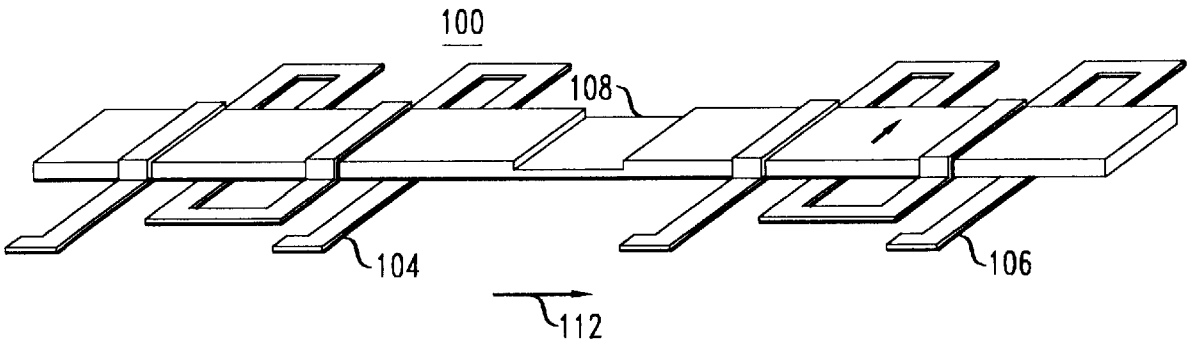
FIG. 8 is a perspective view of a transformer according to yet another embodiment the invention showing the transformer having a thin, planar configuration.

The windings for input and output coils 32, 34 in transformer 10 are wire windings or, alternatively, as shown in FIGS. 6–8, are thin film metallization layers of Cu, Al or other suitable materials deposited and patterned, e.g., as shown. Such metallization layers are prepared in a conventional manner, e.g., as described in C. R. Sullivan and S. R. Sanders, *Proceedings, 24th Annual Power Electronics Specialists Conf.,* p. 33–40, Jun., 1993.

FIG. 6 illustrates a noise-limiting transformer 60 according to an alternative embodiment of the invention. As shown, transformer 60 comprises a thin, square-shaped magnetic core 62 having leg regions 64*a–d,* an input coil thin film conductor 66 and an output coil thin film conductor 68. Magnetic core 62 and conductors 66, 68 are made, e.g., by deposition in a conventional manner using a known multi-step deposition and patterning procedure.

Magnetic core 62 is deposited in such a way that its hard axis of magnetization is in the direction indicated by arrow 72, i.e., parallel to leg regions 64*a* and 64*c*. Also, the magnetic bias of transformer 60 is such that the easy axis orientation is in the direction indicated by arrow 74.

A saturation region, e.g., a geometric constriction region 76, is formed within magnetic core 62, e.g., along leg region 64*b*. Constriction region 76 of transformer 60 has reduced physical dimensions as shown. In this configuration, the cross-sectional area and thus the overall volume along constriction region 76 is reduced, resulting in less magnetic flux flow within the region compared to other areas along magnetic core 62.

Although not shown, it is possible to form a "magnetic-equivalent" constriction region within magnetic core 62 in the manner discussed previously. In using such a region, reduced magnetic flux is achieved by modifying the properties of the region as discussed previously herein.

Typically, it is necessary for one or more saturation features to be included in the soft magnetic material of magnetic core 62. For example, constricted region 76 as shown in FIG. 6 is prepared, e.g., by partial masking during film deposition, or by removal of materials through partial etching, laser ablation or other suitable techniques.

FIG. 7 illustrates a noise-limiting transformer 70 according to yet another embodiment of the invention. Specifically, transformer 70 has an E-core type configuration, as shown. In this embodiment, the magnetic core is made up of a first, top layer 84 formed on a second, bottom layer 86, as shown. An input coil thin film 92 and an output coil thin film 94 are formed to pass through first and second layers 84, 86 as shown. Also, transformer 70 is magnetically biased in such a way that the easy axis orientation, which is indicated by arrow 96, is perpendicular to the long axis of the magnetic core, which is indicated by arrow 98.

In the embodiment shown in FIG. 7, the easy axis biasing is advantageously convenient because the easy axis direction is the same for both the top and bottom legs of the core material. Thus, only one biasing step is needed. As discussed previously, easy axis biasing is achieved by applying an external field or by adding an exchange interaction bias layer. Such easy axis biasing is compared, e.g., with that of transformer 60 shown in FIG. 6, in which the easy axis biasing directions of horizontal legs 64*a,* 64*c* are different than those of vertical legs 64*b,* 64*d*. In those arrangements, separate biasing steps are needed.

FIG. 8 illustrates a transformer 100 according to yet another embodiment of the invention. In this embodiment, magnetic core 62 is not in a closed-loop configuration. An input coil thin film conductor 104 and an output coil thin film conductor 106 are formed around magnetic core 62 as shown. Also, a saturation region 108 is formed within magnetic core 62 and between input and output film layers 104, 106. As discussed previously, saturation region 108 is, e.g., a geometrically constricted region (as shown in FIG. 8) or a "magnetic-equivalent" constriction region (not shown).

In the configuration shown in FIG. 8, some loss in magnetic permeability is possible due to the presence of demagnetizing fields. However, such loss typically is not problematic because of a high aspect ratio (i.e., a length to thickness ratio of the core material) in the film length direction (indicated by arrow 112), especially when transformer 100 is used in the higher-frequency, hard axis operation (for which the permeability is somewhat limited) as compared to the lower-frequency, easy axis operation.

Figure 9A:
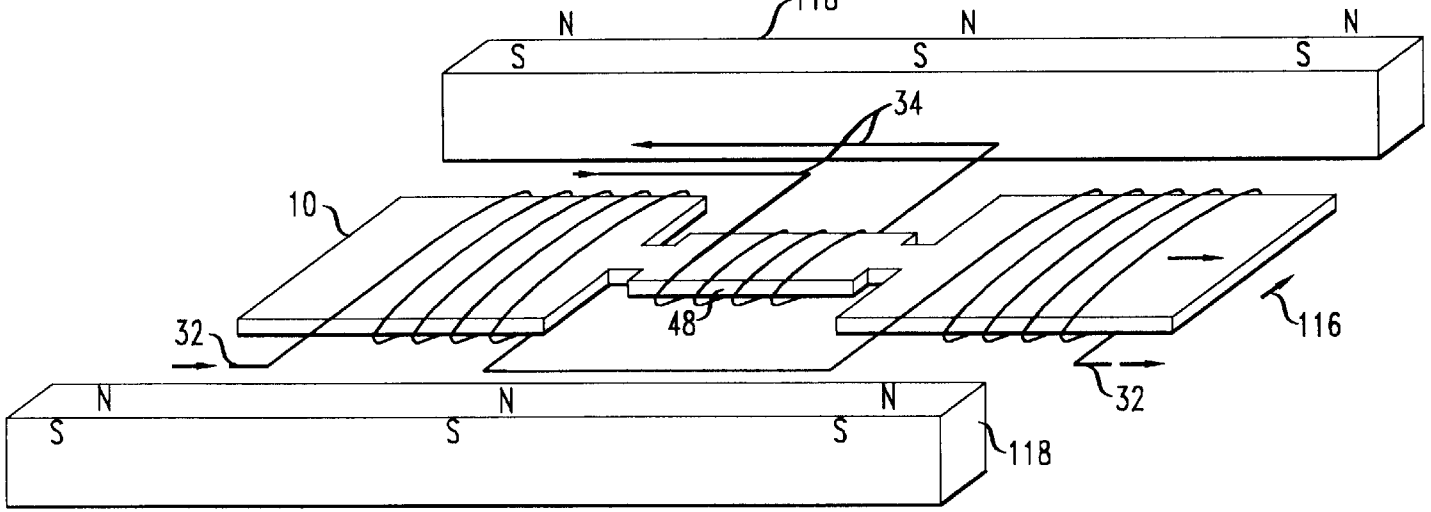
FIG. 9(*a*) is a perspective view of the transformer of FIG. 5 shown using an external bias field for magnetic saturation in the easy direction to avoid magnetic domains and associated domain wall motion.
Figure 9B:
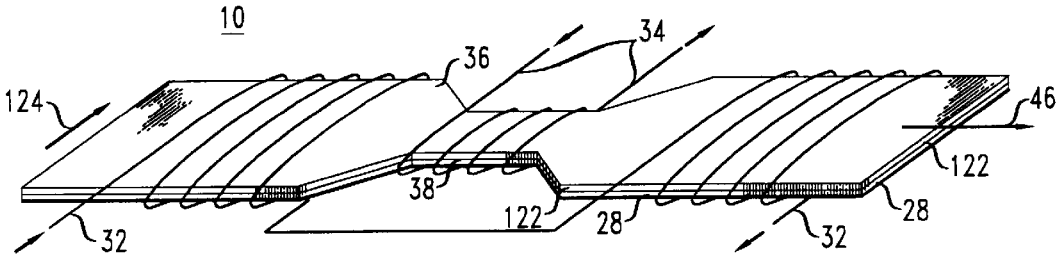
Figure 9C:
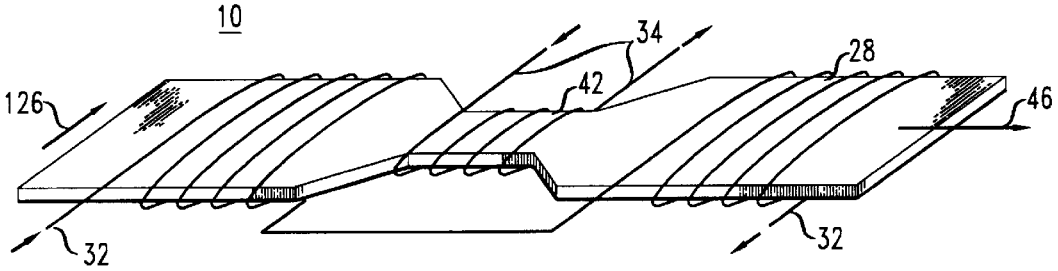

In operating the noise-limiting transformer according to embodiments of the invention disclosed herein, the magnetic core first is easy axis saturated (e.g., by applying a DC field) to obtain a single-domain magnetic state. Then, the magnetic core is operated in the hard axis direction by applying an AC field. In this manner, any hard axis magnetization changes occur by a spin rotation mechanism rather than the loss-laden domain wall motion mechanism. Also, in such operation, the stability of the single-domain magnetic state needs to be secured against exposure to stray fields in excess of the coercivity of the core material, which can partially demagnetize the magnetic core and introduce domain walls. It is not uncommon for stray magnetic fields of a few to several oersted to be present. However, in an effort to mitigate the presence of such magnetic fields, it is possible to operate the inventive transformer in various modified manners as shown in FIGS. 9*a–c* and described below.

As shown in FIG. 9(*a*), an external bias field is applied in the easy axis direction (indicated by arrow 116) by placing at least one permanent magnet 118 on the sides of transformer 10. The strength of the external bias field is at least approximately 2 Oe, but typically is greater than approximately 20 Oe. In this manner, the applied DC field essentially will restore and maintain the single domain state in the easy axis direction, even after exposure to a temporary stray magnetic field. Input coil 32 and output coil 34 shown in FIG. 9(*a*) are wires similar to those shown in FIGS. 2*a–b* and described previously. Alternatively, coils 32, 34 are thin films similar to those shown in FIGS. 5–8 and described previously. Magnets 118 are made of, e.g., known materials such as ferrites, alnico, Fe—Cr—Co, rare earth cobalt, or Nd—Fe—B.

As shown in FIG. 9(*b*), a bias field along the easy axis is provided by using a surface film layer 122 of antiferromagnetic or ferrimagnetic material such as Fe-50% Mn or NiO on magnetic core 28. Typically, the thickness of exchange bias film layer 122 is, e.g., within the range from approximately 20 Å to approximately 1000 Å.

When the material in layer 122 is magnetized along the easy axis (indicated by arrow 124), a magnetic exchange interaction at the interface of layer 122 and magnetic core 28 causes the M-H loop of magnetic core 28 to be shifted along the field axis. With a sufficient shift of the M-H loop (e.g., in excess of the coercivity value), the material of magnetic core 28 is maintained at the single-domain, saturated state along the easy axis even after exposure to stray fields.

Typically, the width of the M-H loop to be within the bias field range. Layer 122 is applied on either side or, alternatively, on both sides of magnetic core 28. Input coil 32 and output coil 34 are similar to those windings discussed previously herein.

Yet another way of providing the stability of the single-domain state as discussed above within a transformer, e.g., transformer 10 shown in FIG. 9(*c*) is to provide a high coercivity, $H_c$, to the material of magnetic core 28 while still maintaining the square M-H loop characteristics thereof. In this manner, neither a bias magnet nor an exchange bias film layer is used.

For example, a coercivity $H_c$, is established within the range from approximately 10 Oe to 50 Oe. It is possible to establish $H_c$ greater than approximately 50 Oe, but $H_c$ should not exceed approximately 200 Oe for the sake of a reasonably high permeability in the hard axis operation. It is possible to process the material of magnetic core 28 to exhibit a high $H_c$ and a square M-H loop by introducing second phase precipitate particles during, e.g., film deposition processes or by post heat treatment. The presence of the particles impedes the domain wall motion. Also, the application of uniaxial stress in the easy axis direction (indicated by arrow 126) creates a high $H_c$ and a square M-H loop.

Figure 10:
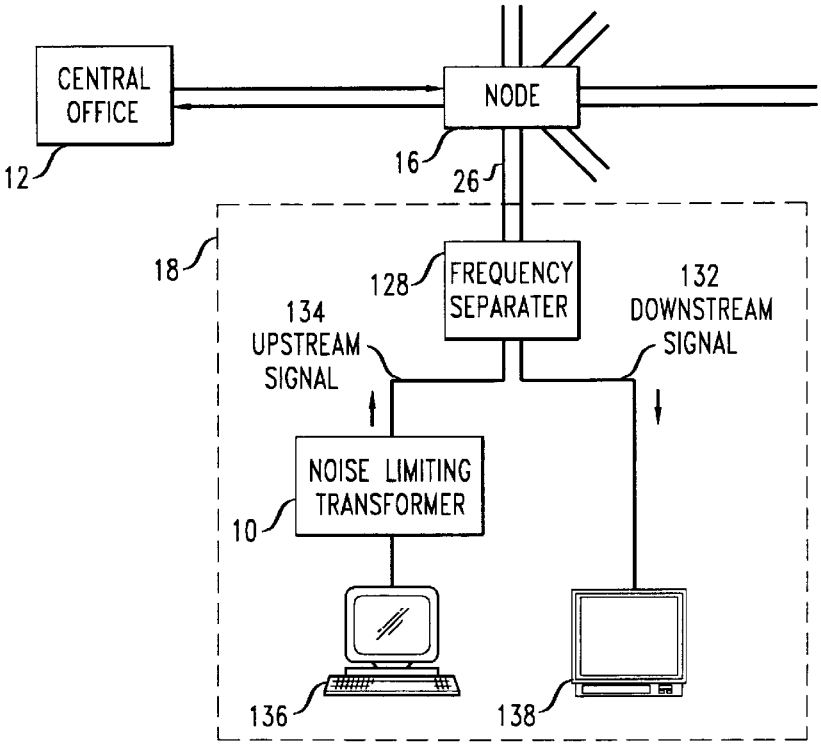
FIG. 10 is a schematic diagram showing an HFC communications system arrangement using a transformer according to the invention.

FIG. 10 illustrates a typical application of the inventive transformer shown, e.g., in FIGS. 2–9 and described herein. Transformer 10 is useful in limiting ingress noise generated from, e.g., a customer premise 18. Typically, transformer 10 is operably connected in a conventional manner in the upstream portion of a communications network beyond the point where the frequency is separated, e.g., by a frequency separator 128, into a downstream portion 132 and an upstream portion 134. As shown, transformer 10 is placed in upstream signal portion 134, e.g., in series between a computer 136 and frequency separator 128. Downstream signal portion 132 connects, e.g., to a television 138 or other suitable equipment. Alternatively, transformer 10 is positioned, e.g., within the communication network at each subscriber premise before the point where the frequency is separated into downstream and upstream portions (not shown), e.g., between node 16 and frequency separator 128.

It will be apparent to those skilled in the art that many changes and substitutions can be made to the embodiments of the noise-limiting transformer and the bidirectional communications system herein described without departing from the spirit and scope of the invention as defined by the appended claims and their full scope of equivalents.

What is claimed is:

1. A transformer, comprising:

a magnetic core having at least one input region and at least one output region wherein said input region and said output region are coaxial;

an input coil for transmitting an input signal, at least a portion of said input coil being wound around at least a portion of said input region; and an output coil for transmitting an output signal, at least a portion of said output coil being wound around at least a portion of said output region, said magnetic core capable of flowing a flux that magnetically couples said input and output coils in such a way that said output signal varies in response to said input signal, said magnetic core including a saturation region in no more than one of said input region and said output region capable of a saturation magnetization state whereby said saturation region limits the flow of said flux through said magnetic core and thus the magnitude of said output signal, said saturation magnetization state limiting said output signal in such a way that said output signal does not vary in response to said input signal, wherein said saturation region is one of a geometrically constricted region of said magnetic core or a portion of the magnetic core modified to be the magnetic equivalent of a geometrically constricted region of said magnetic core, wherein said modification is selected from the group consisting of altering the chemical composition of said saturation region, altering the crystal structure of said saturation region and altering the internal stress state of said saturation region in such a way that said saturation region is the magnetic equivalent of a geometrically constricted region.

2. The transformer as recited in claim 1, wherein said magnetic core is made of one or more materials selected from the group consisting of a Fe-rich alloy and a Co—Fe-based alloy.

3. The transformer as recited in claim 1, wherein said magnetic core has a magnetic-hysteresis (M-H) loop squareness ratio greater than or equal to approximately 0.85.

4. The transformer as recited in claim 1, wherein said magnetic core has an anisotropy field, $H_a$, greater than or equal to approximately 2 oersted (Oe).

5. The transformer as recited in claim 1, wherein said magnetic core has a saturation magnetization, $4\pi M_s$, greater than approximately 3 kilogauss (kG).

6. The transformer as recited in claim 1, wherein said magnetic core has a coercivity, $H_c$, greater than or equal to approximately 10 oersted (Oe).

7. The transformer as recited in claim 1, wherein said magnetic core has a ferromagnetic resonance (FMR) frequency of at least 0.1 GHz.

8. The transformer as recited in claim 1, wherein said magnetic core further comprises a linear body having said output region in spaced relation to said input region and wherein said saturation region is formed therebetween.

9. The transformer as recited in claim 1, wherein said magnetic core further comprises a square frame having an input leg region, an opposing output leg region substantially parallel to and spaced apart from said input leg region, and a pair of connecting legs substantially perpendicular to said input and output leg regions, and wherein said saturation region is formed in at least one of said connecting leg regions.

10. The transformer as recited in claim 1, further comprising at least one permanent magnet in spaced relation to said transformer in such a way that a bias field at least 20 Oe is applied to said transformer in the easy axis direction.

11. The transformer as recited in claim 1, further comprising a film layer formed on at least one side of soft magnetic core for exchange-biasing said magnetic core, said film layer made of a material selected from the group consisting of an antiferromagnetic materials and a ferromagnetic material.

12. A method for making a noise-limiting transformer, said method comprising the steps of:

providing a magnetic core having at least one input region and at least one output region, wherein said input region and said output region are coaxial, said input region having associated therewith an input coil for transmitting an input signal and said output region having associated therewith an output coil for transmitting an output signal, said magnetic core capable of flowing a flux that magnetically couples said input and output coils in such a way that said output signal varies in response to said input signal; and forming at least one saturation region within said magnetic core for limiting the flow of said flux through said magnetic core in such a way that the magnitude of said flux output signal is limited and does not vary in response to said input signal, wherein said forming step comprises geometrically constricting the volume of a portion of said magnetic core between said input and output regions.

13. The method as recited in claim 12, wherein said forming step comprises altering the chemical composition of a portion said magnetic core between said input and output regions in such a way that the magnitude of said output signal is limited and does not vary in response to said input signal.

14. The method as recited in claim 12, wherein said forming step comprises altering the internal stress state of said saturation region in such a way that the magnitude of said output signal is limited and does not vary in response to said input signal.

15. The method as recited in claim 12, wherein said forming step further comprises selectively patterning said magnetic core.

16. The method as recited in claim 12, wherein said input and output coils are formed by depositing a thin film of an electrically conductive material on said transformer and patterning said thin film in such a way to form said input and output coils.

17. A transformer, comprising:

a magnetic core having at least one input region and at least one output region; an input coil for transmitting an input signal, at least a portion of said input coil being wound around at least a portion of said input region; and an output coil for transmitting an output signal, at least a portion of said output coil being wound around at least a portion of said output region, said magnetic core capable of flowing a flux that magnetically couples said input and output coils in such a way that said output signal varies in response to said input signal, said magnetic core including a saturation region between said input region and said output region capable of a saturation magnetization state whereby said saturation region limits the flow of said flux through said magnetic core and thus the magnitude of said output signal, said saturation magnetization state limiting said output signal in such a way that said output signal does not vary in response to said input signal, wherein said saturation region is one of a geometrically constricted region of said magnetic core or a portion of the magnetic core modified to be the magnetic equivalent of a geometrically constricted region of said magnetic core, wherein said modification is selected from the group consisting of altering the chemical composition of said saturation region, altering the crystal structure of said saturation region and altering the internal stress state of said saturation region in such a way that said saturation region is the magnetic equivalent of a geometrically constricted region.

* * * * *